US005171184A

United States Patent [19]

Saucier et al.

[11] Patent Number: 5,171,184

[45] Date of Patent: Dec. 15, 1992

[54] TENSIONED FIRE DAMPER ASSEMBLY AND METHOD

[75] Inventors: Mark E. Saucier; Timothy I. Stewart, both of Hobart, Ind.; Stanley W. Szykowny, Crete, Ill.

[73] Assignee: Press Mechanical, Inc., Cicero, Ill.

[21] Appl. No.: 748,133

[22] Filed: Aug. 21, 1991

[51] Int. Cl.[5] ..... A62C 2/14

[52] U.S. Cl. ..... 454/257; 454/369; 236/49.2; 160/1; 285/187

[58] Field of Search ..... 236/49.2; 454/257, 258, 454/369; 98/1; 160/1; 49/1, 3; 285/187

[56] References Cited

U.S. PATENT DOCUMENTS

| | | | |
|---|---|---|---|
| 222,242 | 12/1879 | Campbell | 126/285 |
| 327,321 | 9/1885 | Scheuermann | 126/285 |
| 3,575,229 | 4/1971 | Alley | 160/1 |
| 3,800,846 | 4/1974 | Kurz | 160/1 X |
| 4,081,173 | 3/1978 | McCabe | 251/308 |
| 4,113,230 | 9/1978 | McCabe | 251/305 |
| 4,114,646 | 9/1978 | McCabe | 137/601 |
| 4,579,047 | 4/1986 | Zielinski | 98/1 |
| 4,934,744 | 6/1990 | Samer, Jr. et al. | 285/187 X |

FOREIGN PATENT DOCUMENTS 604106 8/1978 Switzerland .

*Primary Examiner*—William E. Tapolcai
*Attorney, Agent, or Firm*—Jenner & Block

[57] ABSTRACT

A tensioned fire damper assembly and method are disclosed. The assembly includes a damper tensioning frame for tensionably mounting a fire damper within a duct or other mounting aperture, thereby allowing substantially unrestricted thermal damper expansion into an expansion gap located between the aperture and the tensioning frame. Screw type tensioning fasteners can be employed to tensionably mount the frame, and the degree of frame tension can be regulated by using tensioning fastener bushings which limit the threadable movement of the fasteners. Additional embodiments are disclosed in which multiple dampers can be accommodated in a tensionable frame.

42 Claims, 2 Drawing Sheets

Fig. 3
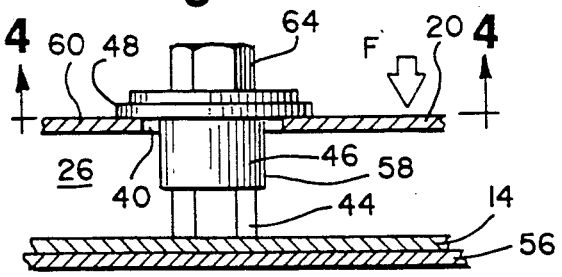
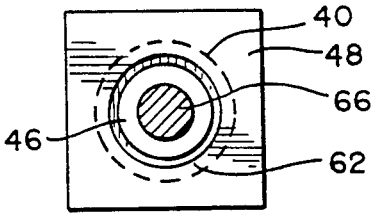
Fig. 4
Fig. 5
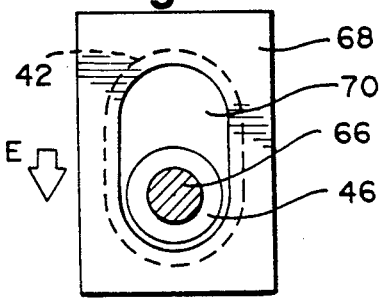
Fig. 6
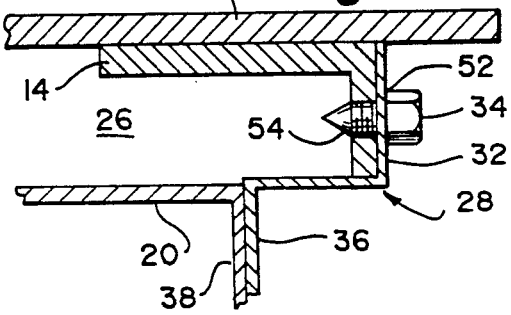
Fig. 7
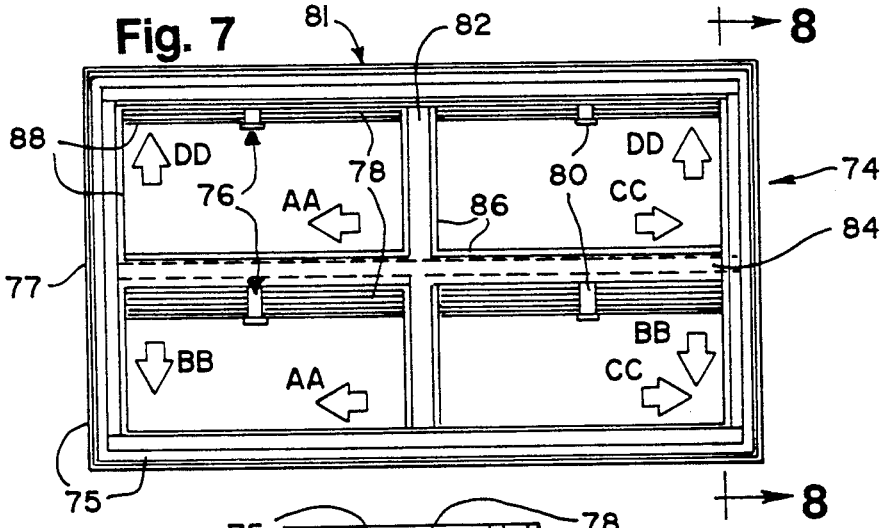
Fig. 8
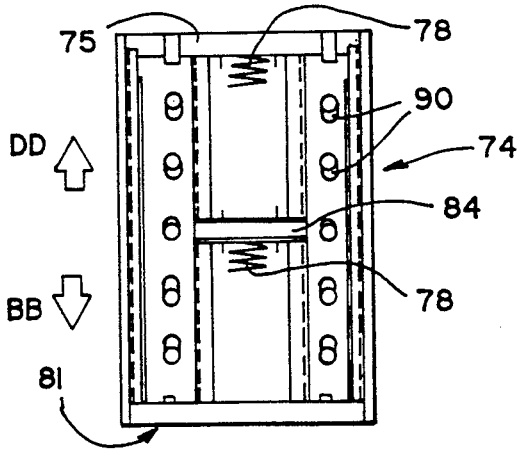

TENSIONED FIRE DAMPER ASSEMBLY AND METHOD

FIELD OF THE INVENTION

The invention relates to a fire damper apparatus and a method for mounting fire dampers. More particularly, the invention relates to an apparatus and method for providing a tensionably mounted fire damper within a heating, ventilating or air conditioning mounting duct or other orifice.

BACKGROUND OF THE INVENTION

The heating, ventilating and air conditioning of various building spaces typically requires that air flows from one area to another. The required air flow is usually accomplished by forcing or otherwise allowing air to pass from one area to another through duct work or apertures located in walls, floors, roofs or ceilings. While such air flows are necessary to maintain the desired heating, ventilating and air-conditioning environment under normal conditions, air flow through these openings is undesirable during a fire because air flow from one area to another can contribute to the spread or intensity of the fire. For this reason, ducts and other air flow apertures frequently are fitted with fire dampers which can block the flow of air through these apertures when the dampers reach a predetermined temperature.

Fire dampers used in the above-described manner generally contain a plurality of spring-loaded metal blades or louvers held in an open or retracted position within a damper frame by a thermally fused link. When the temperature of the link reaches the melting point of the link material, the link melts or otherwise deforms. Without the louver retention provided by the link, the spring-loaded louvers move into a closed position across the fire damper air flow area, thereby preventing the spread of fire or heated air through the duct or orifice.

Fire damper assemblies used in the above-described manner must be designed to survive severe thermal and mechanical conditions. Because damper blades and frames must withstand the high temperatures encountered in a fire, fire damper components are usually constructed from a metal such as steel. These metal damper components tend to expand as their temperature increases. Therefore, fire dampers must be designed so that they will be able to function when their components are in the expanded configuration expected during fire conditions. Additionally, damper assemblies used in critical applications such as in nuclear power plants must be designed to survive and function during or after seismic events of a magnitude specified in government regulations or in other building or fire codes.

One method of dealing with the thermal expansion of fire damper assemblies is to mount the assembly so that an expansion gap remains between the damper frame and the damper mounting aperture on at least one horizontal and one vertical side of the frame. When the high temperatures associated with a fire are encountered, the assembly frame expands into the gap. The frame expansion provides additional clearance for the simultaneously expanding damper louvers, which might bind or otherwise fail to move to a closed position if the expanded blades were forced to move through an nonexpanded frame.

Expanding frame dampers such as those described above present several design difficulties. Primarily, these difficulties stem from the need to mechanically secure the damper within the mounting aperture while still allowing the damper frame to expand. Additionally, most applications require that any expansion gap left between the damper frame and the mounting aperture remain substantially airtight under both normal and fire conditions.

Various prior art designs have compromised either the mechanical mounting of the damper frame or the free expansion of the damper frame. For example, U.S. Pat. No. 4,579,047 to Zielinski discloses a damper having an inner and an outer frame with an expansion gap between the two frames. To accommodate expansion of the damper frame, Zielinski incorporates resilient spacers within an expansion gap. These spacers provide sufficient compressive force on the inner frame to maintain its position within the outer frame while at the same time purportedly yielding to an expanding damper frame under fire conditions. In this design, the free expansion of the frame appears to be compromised because the expanding frame must overcome the compressive force of the resilient spacers as the frame expands into the expansion gap under fire conditions. Additionally, Zielinski's need to accommodate frame expansion in a direction perpendicular to the plane defined by the damper opening requires that his damper frame be maintained between angle iron spacers mounted further apart than the nonexpanded depth of his damper frame. The spacing of the angle iron spacers appears to present a potential for slidable movement that could comprise the physical stability of the damper assembly under vibratory conditions such as those encountered in a seismic event.

Accordingly, a need exists for a fire damper assembly which permits substantially unrestricted thermal expansion of the fire damper frame under fire conditions while at the same time providing for a mechanically stable mounting of the damper frame within the mounting aperture under non-fire conditions.

SUMMARY OF THE INVENTION

In accordance with the present invention, a tensioned fire damper assembly is disclosed which allows substantially unrestricted thermal expansion of the fire damper frame into an expansion gap while at the same time providing a tensioned damper mounting frame which improves the mechanical stability of the fire damper assembly over that known in the prior art.

More specifically, in one embodiment of the invention, structure is included for framing the damper structure, tensionably mounting the framing structure within a mounting aperture such as the cross section of a duct or an aperture in a building surface such as a wall or floor and blocking air flow at a predetermined temperature. Additional structure can be included for lining the mounting aperture and securing the frame tensioning structure thereto. Air foil structure can also be included to block the flow of air through the expansion gap formed between the tensioned frame and the mounting aperture.

In another embodiment of the invention, a fire damper assembly is secured within a fire damper tensioning frame which is then tensionably mounted within a mounting aperture. A plurality of frame tensioning fasteners can be employed to tensionably mount the fire damper frame in a generally concentric orientation within the mounting aperture so that a perimetric expansion gap surrounds the tensioned fire damper. Additionally, a mounting sleeve may be used to line the mounting aperture and receive the frame tensioning fasteners.

Still another embodiment of the invention includes a mounting sleeve for lining an aperture, a fire damper for blocking air flow at a predetermined temperature, a damper tensioning frame for surrounding the damper and for allowing the damper to be tensionably mounted within the aperture, an air foil for blocking the flow of air through the expansion gap formed between the mounting sleeve and the damper tensioning frame, and a plurality of screw-like frame tensioning fasteners for providing tensioning forces to various points of the frame. The frame can be rectangular in shape, and one or more tensioning fasteners can be used on each side of the frame so that opposing frame tensioning forces can be exerted on opposite sides of the frame, thereby permitting each side of the frame to thermally expand into the perimetric expansion gap.

Other embodiments include screw type tensioning fasteners which employ bushings to limit the degree of tension transferred to the frame by the fasteners, as well as multiple damper assemblies useful for placement in mounting apertures which require larger cross sectional flow areas than can be controlled by a single damper. Methods are disclosed for tensionably mounting fire dampers within mounting apertures which include the steps of securing a damper within a damper tensioning frame, attaching the frame within an aperture at one point, and tensionably attaching the frame to the aperture at a second, generally opposing point.

In accordance with one aspect of the invention, a tensioned fire damper assembly is provided in which a fire damper frame can thermally expand in a substantially unrestricted manner into an expansion gap.

In accordance with another aspect of the invention, a fire damper assembly is provided that includes a tensioned fire damper frame immovably attached within a mounting aperture under normal conditions.

In accordance with yet another aspect of the invention, a tensioned fire damper assembly includes tensionable fasteners which mechanically support the fire damper under normal temperature conditions and which guide the expansion of an expanding damper tensioning frame under heat induced expansion conditions.

BRIEF DESCRIPTION OF THE DRAWINGS

FIG. 3 is a fragmentary side elevation view showing fire damper assembly components used to tensionably mount the damper frame to the mounting sleeve;

FIG. 4 is a sectional top plan view of the components shown in FIG. 3, taken along line 4—4 of FIG. 3;

FIG. 5 is a sectional top plan view showing an elongated mounting aperture for use in off-center damper frame tensioning locations;

FIG. 6 is a fragmentary side elevational view illustrating the use of an expansion gap air foil;

FIG. 7 is a front elevational view of an another embodiment of the invention which incorporates four fire dampers; and FIG. 8 is a cross sectional view of the four damper embodiment shown in FIG. 7, taken along line 8—8 of FIG. 7.

DETAILED DESCRIPTION OF THE INVENTION

The following discussion and description of the drawings describes two embodiments of a fire damper assembly in accordance with the invention that can be tensionably mounted within a duct or other mounting aperture. In the FIGURES, in which like numerals refer to like parts, FIGS. 1–6 illustrate an embodiment of the invention which permits a fire damper to be tensionably mounted within the mounting sleeve by using screw type tensioning fasteners to tensionably secure a damper tensioning frame within a mounting sleeve. In FIGS. 7–8, four fire dampers are tensionably mounted within a single fire damper assembly, thereby permitting the use of relatively small fire dampers in relatively large apertures.

Figure 1:
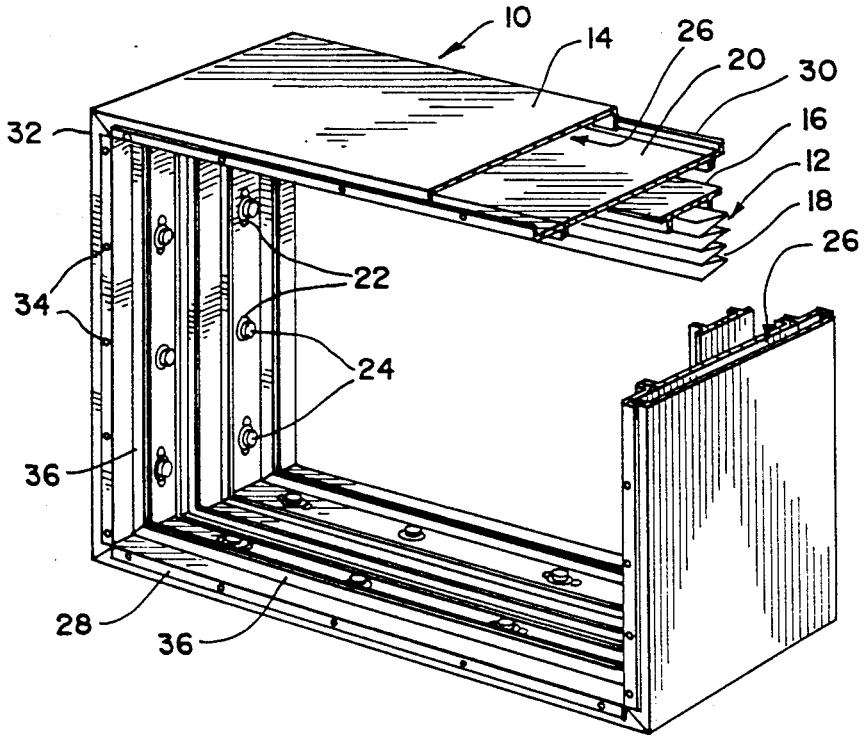
FIG. 1 is a fragmentary perspective view of a tensioned fire damper assembly.
Figure 2:
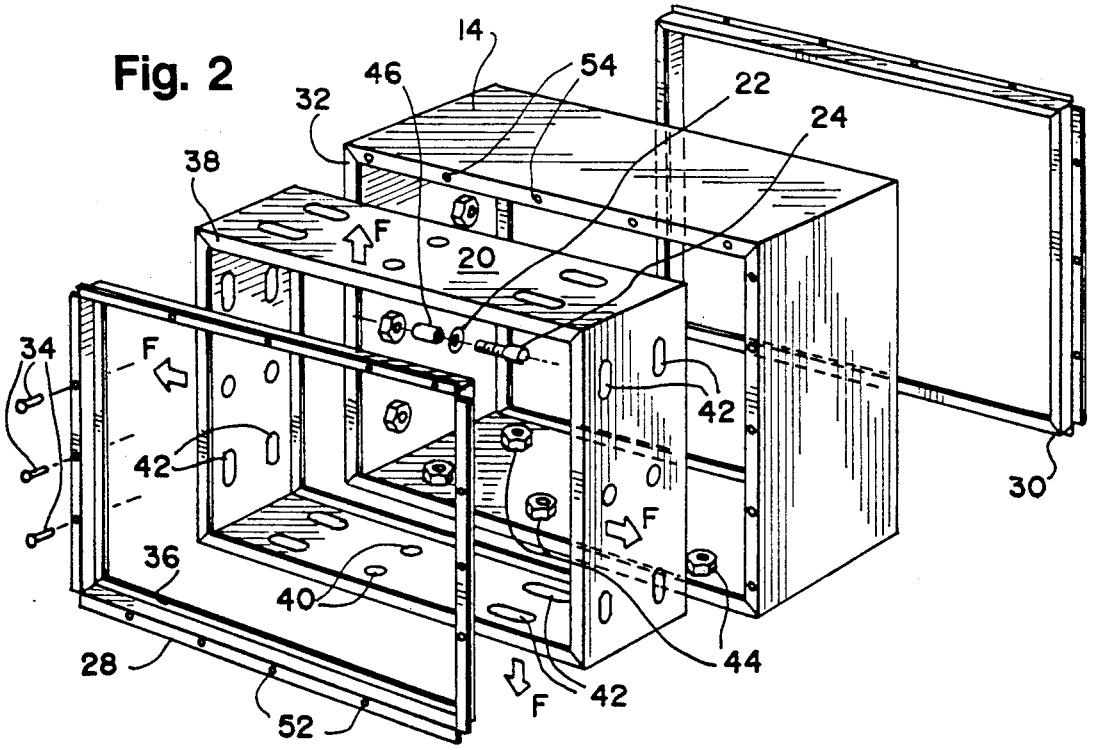
FIG. 2 is an exploded perspective view of the assembly shown in FIG. 1.

The general arrangement of damper assembly components is best described in conjunction with FIGS. 1 and 2. FIGS. 1 and 2 are perspective and exploded perspective views of a tensioned fire damper assembly 10 having a tensionably mounted fire damper 12 (shown only in FIG. 1) mounted within a mounting sleeve 14. Typically, mounting sleeve 14 is dimensioned to fit concentrically within a mounting aperture or duct so that air cannot pass between the aperture and mounting sleeve 14. Alternatively, sleeve 14 may be dimensioned smaller than the mounting aperture and sealed within the aperture by any of the penetration sealing means known in the art. In other embodiments, the mounting aperture itself (not shown) can function as the mounting sleeve if suitably prepared for receiving the damper tensioning devices discussed in connection with FIGS. 3, 4 and 5. Damper assembly 10 may be mounted in any vertical, horizontal or inclined orientation in which damper 12 will function properly.

Fire damper 12 can be any suitable damper known in the art. In the illustrated embodiment, the damper includes a fire damper frame 16 which is used to retain and guide fire damper louvers 18. As illustrated, louvers 18 are shown in their normal retracted position. When high temperatures are encountered during a fire or other thermal event, a thermally fusible link 80 (see FIG. 7) melts, allowing louvers 18 to drop across damper frame 16, thereby blocking the flow of air through damper frame 16. One suitable fire damper for use in the invention is the Model No. 319 ALV/4 available from Reed Products.

Still referring to FIGS. 1 and 2, fire damper frame 16 (not shown in FIG. 2) is welded or otherwise secured to a damper tensioning frame 20 which is useful for tensionably mounting fire damper 12 within mounting sleeve 14. A plurality of damper tensioning washers 22 and damper tensioning bolts 24 are used to tensionably mount tensioning frame 20 within sleeve 14 in such a manner as to form a perimetric expansion gap 26 between sleeve 14 and tensioning frame 20. Expansion gap 26 accommodates the thermal expansion of tensioning frame 20 under high temperature conditions. When frame 16 is heated during a fire, tensioning frame 20 can thermally expand in a substantially unrestricted manner into gap 26 toward sleeve 14 on all sides, thereby insuring the movement of blades 18 within frame 16. Preferably, tensioning frame 20 is constructed from 14 gauge steel.

While in FIG. 1, the preferred embodiment shows expansion gap 26 extending around the perimeter of a damper tensioning frame 20, other embodiments are possible in which an expansion gap exists only along a portion of the perimeter of a damper 12. One such configuration is explained in conjunction with the multiple damper assembly of FIGS. 7 and 8. While the illustrated embodiment of FIG. 1 is preferred, the alternative embodiments like that shown in FIG. 7 can still accommodate the expansion of the frame in both vertical and horizontal directions if fitted with the mounting apertures of the type shown and explained in conjunction with in FIGS. 5 and 8.

Referring now to FIG. 2, damper 12 also includes a front air foil 28 and a rear air foil 30. Air foils 28 and 30 are useful for blocking the flow of air through expansion gap 26 (see FIG. 1), thereby substantially preventing the flow of air through tensioned damper assembly 10 when damper louvers 18 are in a closed condition. Air foils 28 and 30 are secured to mounting sleeve air foil lips 32 by a number of air foil mounting screws 34. When air foils 28 and 30 have been secured in this manner, air foil damper lips 36 rest against damper tensioning frame lips 38, thereby preventing the flow of air through expansion gap 26. Air foils 28 and 30 may be omitted from tensioned damper assembly 10 if the air flow that can pass through expansion gap 26 is deemed inconsequential in a particular application.

FIG. 2 also illustrates that damper tensioning frame 20 includes both centrally located frame apertures 40 and off-center located frame apertures 42 located on either side of damper 12. As explained later in conjunction with FIG. 5, off-center located frame apertures 42 are elongate to allow for the heat induced net expansion of tensioning frame 20 parallel to the elongate axis of aperture 42.

Damper tensioning bolts 24 tensionably secure frame 20 within sleeve 14. Bolts 24 are first inserted through apertures 40 and 42 towards sleeve 14 and then threadably inserted into tensioning screw mounting nuts 44 which are welded or otherwise fixedly secured to the inner surfaces of mounting sleeve 14 as shown. Bolts 24 tension frame 20 by exerting tensioning forces against tensioning frame 20 in the direction of arrows F when bolts 24 are threadably tightened into nuts 44. Additional mounting bolt-related components which will be described in conjunction with FIGS. 3, 4 and 5 include tensioning bolt bushing 46, frame aperture weld plate 48 and damper tensioning washer 22. Finally, also visible in FIG. 2 are air foil lip apertures 52 and tensioning frame lip apertures 54 through which air foil mounting screws 34 are passed and threadably secured, and mounting sleeve weld plates 56 (see FIGS. 3 and 6), which are useful for reinforcing mounting sleeve 14.

FIG. 3 and 4 illustrate the detail of the various damper frame mounting components used in the preferred embodiment to tensionably mount damper tensioning frame 20 within mounting sleeve 14. A centrally located frame aperture 40 is located in the center of each side of tensioning frame 20 as shown in FIG. 2. Aperture 40 has a diameter greater than the outer diameter of tensioning screw bushing 46 so that aperture 40 can freely pass over the outer cylindrical surface 58 of bushing 46. Preferably, frame aperture weld plate 48 may be welded to tensioning frame inner surface 60 to reduce aperture 40. Aperture weld plate 48 has a weld plate aperture 62 which is similar in shape and slightly smaller in diameter than aperture 40, but still of sufficient diameter to allow bushing 46 to move freely within the aperture 62. Tensioning bolt 24 has a head portion 64 and a threaded portion 66. As shown in FIG. 3, washer 22 has an inner diameter smaller than the outer diameter of head portion 64 and larger than the outer diameter of threaded portion 66, as well as an outer diameter greater than the diameter of plate aperture 62. This makes washer 22 useful for transferring tensioning force from bolt 24 to weld plate 48 and frame 20. Bushing 46 has an internal diameter sufficiently large to allow threaded portion 66 to pass through it, and has an axial dimension sufficiently short to permit bolts 24 to be tightened to a point where frame 20 is tensioned to the desired amount in the direction of sleeve 14 by the cooperative action of bolts 24 located on opposing sides of tensioning frame 20. The use of bushing 46 is preferred because it both regulates the tensioning force applied to frame 20 and because it provides a smooth surface for guiding the expanding frame 20 into gap 26. The general diametric relationship of threaded portion 66, bushing 46 and apertures 40 and 62 just described is best shown in the cross sectional view of FIG. 4. It is preferred that weld plates 48 and 56 shown in FIGS. 3 and 4 are constructed from 10 gauge steel.

The tensioned mounting of tensioning frame 20 is accomplished in the following manner. First, frame 20 is placed in a generally concentric orientation within sleeve 14. Then, damper tensioning bolts 24 bearing washers 22 and bushings 46 are inserted into plate apertures 62 and frame apertures 40 so that washers 22 abut weld plates 48 and threaded bolt portions 66 and bushings 46 protrude through apertures 62. Threaded bolt portions 66 then are threadably inserted into mounting nuts 44. Bolts 24 should be installed hand tight. When bolts 24 on opposing sides of frame 20 have been tightened to the extent permitted by bushings 46, bolt heads 64 exert tensioning forces through washer 22 and weld plate 48 to frame 20 in the direction indicated by arrows F. This causes frame 20 to remain in a tensioned condition under normal conditions.

When frame 20 expands under fire conditions, the tensioned mounting system just described allows frame 20 to freely expand into gap 26. Typically, the width of gap 26 will be about ⅛ inches per foot of damper height or width. As the sides of frame 20 perpendicular to the portion of frame 20 shown in FIG. 3 expand, the illustrated portion of frame 20 will move in the direction indicated by arrows F. Because plate aperture 62 is larger than the outer surface of bushing 46, frame 20 will freely move in the direction of arrow F along bushing 46. Furthermore, the initial movement of frame 20 in this direction initially is promoted by the tensioning force provided by bolt 24 until sufficient expansion has occurred to negate the tensioning effects of bolt 24. Thus, frame 20 can expand in a substantially unrestricted manner into gap 26, thereby assuring that blades 18 will be able to operate properly despite any heat-induced damper expansion.

Turning next to FIG. 5, an off-center located weld plate 68 has an elongated weld plate aperture 70 slightly smaller in size than frame aperture 42. The elongated nature of off-center located apertures 42 and 70 accommodates the net expansion of frame 2 in the direction of arrow E. This expansion occurs because the region of frame 20 on either side of apertures 40 expands while the movement of frame 20 away from arrow E is prevented by the movement limiting action of bolts 24 mounted through centrally located apertures 40 as shown in FIGS. 2, 3 and 4. Elongated apertures such as 42 and 70 are preferred whenever frame 20 is secured in a location where expansion of frame 20 is likely to result in a shift in aperture location. As shown in FIG. 5, the elongated axis of the aperture should be oriented in the direction of net frame expansion and bolt 24 positioned at the aperture end farthest from the center of frame 20.

It is to be understood that other fasteners, other threaded members or other structure known in the art suitable for securing frame 20 within sleeve 14 in a tensioned position can be utilized in accordance with the invention.

FIG. 6 illustrates the attachment of air foil 28 to mounting sleeve 14. As previously described in connection with FIG. 2, air foil sheet metal mounting screws 34 are threadably secured through air foil lip apertures 52 and tensioning frame lip apertures 54, causing air foil damper lips 36 to abut damper tensioning frame lips 38. This prevents air from flowing through expansion gap 26. Preferably, air foil 28 is constructed from 22 gauge stainless steel, as air foils of this thickness or thinner are readily deformed by an expanding tensioning frame 20. Finally, although mounting screws 34 are shown, air foil 28 may be riveted, welded or fastened by any other manner known in the art.

FIGS. 7 and 8 illustrate a multiple damper assembly 74 having four fire dampers 76 mounted in a two by two matrix within a mounting sleeve 77. Each damper includes a plurality of louvers 78 and a thermally-fusible link 80 as discussed in conjunction with FIG. 1. Dampers 76 are mounted in a damper tensioning frame 81. Assembly 74 is useful in apertures having a greater cross-sectional area than can be accommodated by single damper assembly 10. Such a multiple damper assembly permits the use of standard sized fire dampers in oversized apertures. Tensioning frame 81 includes a vertical inner member 82 and a horizontal inner member 84 between damper inner sides 86 of dampers 76. Damper frame inner sides 86 are fixedly secured to sleeve members 82 and 84, while damper outer sides 88 are secured to tensioning frame 81 in the manner previously discussed in conjunction with single damper assembly 10.

Multiple damper assembly 74 differs from assembly 10 because an expansion gap 75 (not visible in FIG. 7) is located only between tensioning frame 81 and sleeve 77. As a result, net individual damper 76 expansion occurs in the direction of arrows AA, BB, CC and DD as shown in FIGS. 7 and 8, and not in the direction of each damper side as is the case with the single damper embodiment shown in FIG. 1. This requires that each side of tensioning frame 81 include elongate apertures 90 oriented as shown in FIG. 8 to allow for the net outward expansion.

Other configurations of multiple damper assemblies can be built using the multiple damper techniques just described. For example, two other useful configurations not shown include damper assemblies in which two dampers are located horizontally or vertically adjacent one another. In these embodiments, the expansion gap preferably is located on the three sides of each individual damper assembly not adjacent the other damper.

While the invention has been described with respect to certain preferred embodiments, other configurations, modifications and rearrangements of the tensioned fire damper invention described can be constructed without departing from the invention as described in the appended claims.

What is claimed is:

1. A fire damper assembly for mounting within an aperture comprising:

fire damper means for blocking air flow when a predetermined temperature is reached;

tensionable damper framing means for framing said damper and for allowing said framing means to be tensionably mounted within the aperture, said framing means having outer dimensions sufficiently less than the dimensions of the aperture such that a thermal expansion gap is formed between at least a portion of the perimeter of the aperture and said framing means when said framing means is mounted within the aperture; and frame tensioning means for tensionably mounting said framing means within the aperture and for permitting thermal expansion of the damper means.

2. The assembly of claim 1 which further includes air foil means for blocking the flow of air through said expansion gap.

3. The assembly of claim 2 which further includes aperture sleeve means for lining the aperture, said sleeve means having inner dimensions sufficiently large that said thermal expansion gap is formed between said sleeve and said framing means when said framing means is mounted within said sleeve means.

4. The assembly of claim 3 wherein said frame tensioning means connects said framing means to said sleeve means.

5. The assembly of claim 1 wherein said expansion gap extends perimetrically around said framing means.

6. The assembly of claim 5 which further includes aperture sleeve means for lining the aperture, said sleeve means having inner dimensions sufficiently large that said perimetric expansion gap is formed between said sleeve means and said framing means when said framing means is mounted in a generally concentric orientation within said sleeve means.

7. The assembly of claim 6 wherein said sleeve means includes frame tensioning means receiving means for accepting said frame tensioning means.

8. The assembly of claim 7 wherein said frame tensioning means includes outwardly directed bolt means threadably insertable in said frame tensioning means receiving means for tensionably mounting said framing means within said sleeve means and for guiding said framing means into said gap when said framing means undergoes heat-induced expansion.

9. The assembly of claim 6 which further includes air foil means for blocking the flow of air between said sleeve means and said framing means.

10. A fire damper assembly for tensionably mounting a fire damper within an aperture comprising:

a fire damper for blocking air flow when a predetermined temperature is reached;

a damper tensioning frame for retaining said damper and for allowing said damper to be tensionably mounted within the aperture; and at least one frame tensioning fastener connected between said frame and an edge of the aperture for tensionably securing said frame within the aperture so that a thermal expansion gap is formed between at least a portion of the perimeter of said frame and an edge of the aperture.

11. The assembly of claim 10 which further includes a mounting sleeve for lining the aperture and for receiving a portion of said at least one fastener.

12. The assembly of claim 10 which further includes at least one air foil for blocking the flow of air through said expansion gap.

13. The assembly of claim 12 in which said at least one air foil is deformable by heat expansion of said tensioning frame.

14. The assembly of claim 11 wherein said damper is tensionably mounted in a generally concentric orientation within the aperture thereby defining a generally perimetric expansion gap.

15. The assembly of claim 11 including a plurality of fasteners for tensioning said frame within the aperture.

16. The assembly of claim 11 wherein said at least one fastener is generally perpendicularly directed from a surface of said tensionable frame toward an edge of the aperture.

17. The assembly of claim 16 including a plurality of perpendicularly directed fasteners.

18. The assembly of claim 17 wherein said plurality of fasteners are damper tensioning bolts, each said bolt having a head portion and a threaded portion, said threaded portions insertable through apertures in said frame toward said sleeve and threadably insertable into said sleeve for tensionably mounting said frame within said sleeve by turning said screw head portion.

19. The assembly of claim 18 wherein at least one of said frame apertures is elongated for accommodating the lateral expansion of said tensionable frame when said frame is heated.

20. The assembly of claim 18 which further includes at least one tensioning bolt bushing for limiting the distance that a tensioning bolt can be threadably inserted into said sleeve.

21. The assembly of claim 11 further comprising a plurality of generally rectangular, adjacently mounted dampers wherein said tensioning frame includes at least one inner sleeve member between adjacent dampers for tensionably mounting adjacent damper sides thereto.

22. A tensioned fire damper assembly comprising:

a mounting sleeve for lining an aperture;

a fire damper for blocking air flow when a predetermined temperature is reached;

a damper tensioning frame for retaining said damper and for allowing said damper to be tensionably mounted within the aperture;

at least one air foil mounted to said sleeve and abutting said tensioning frame for blocking the flow of air through said expansion gap; and a plurality of frame tensioning fasteners connected between said frame and said sleeve for tensionably securing said frame so that a perimetric thermal expansion gap is formed between said frame and said mounting sleeve when said frame is mounted in a generally concentric orientation within said aperture.

23. The assembly of claim 22 wherein said plurality of fasteners includes damper tensioning bolts, each said bolt having a head and a threaded portion, said threaded portions insertable through apertures in said frame toward said sleeve and threadably insertable into said sleeve for tensionably mounting said frame within said sleeve by turning said screw head portion.

24. The assembly of claim 23 wherein said sleeve includes a plurality of tensioning bolt mounting nuts for receiving said tensioning screws.

25. The assembly of claim 23 wherein at least one said fastener includes a tensioning bolt bushing insertable over at least one said bolt between said frame and said sleeve for limiting the distance said bolt may be threadably inserted into said sleeve, said bushing having outer dimensions sufficiently small to allow said frame aperture to move over said bushing as said frame expands toward said sleeve.

26. The assembly of claim 25 wherein said frame, said aperture and said sleeve are substantially rectangular.

27. The assembly of claim 26 wherein at least one said fastener is used to connect each side of said rectangular frame to a corresponding side of said rectangular sleeve.

28. The assembly of claim 26 wherein at least one centered and one off-centered fastener are used to connect each side of said rectangular frame to said rectangular sleeve, each centered fastener passing through a substantially round centrally located frame aperture, and each off-centered fastener passing through an elongated off-center frame aperture.

29. The assembly of claim 26 which includes a plurality of adjacently mounted fire dampers within said tensioning frame, said frame further including at least one inner sleeve member between adjacent dampers for mounting adjacent damper sides thereto.

30. The assembly of claim 29 wherein each said tensioning frame aperture is elongated for accommodating heat-induced expansion of said frame.

31. A method of tensionably mounting a fire damper within an opening comprising the steps of:

securing a fire damper within a damper tensioning frame;

attaching said frame within the opening at a first point; and tensionably attaching said frame within the opening at a generally opposing second point.

32. The method of claim 31 further comprising tensionably attaching said frame at both said first and second points.

33. The method of claim 32 further comprising tensionably attaching a rectangular frame within a rectangular opening on at least one point on each side of said rectangular frame.

34. A fire damper mounting assembly for tensionably mounting a fire damper within an aperture comprising:

tensionable damper framing means for framing the fire damper and for allowing said framing means to be tensionably mounted within the aperture, said framing means having outer dimensions sufficiently less than the dimensions of the aperture such that a thermal expansion gap is formed between at least a portion of the perimeter of the aperture and said framing means when said framing means is mounted within the aperture; and frame tensioning means for tensionably mounting said framing means within the aperture.

35. The assembly of claim 34 which further includes air foil means for blocking the flow of air through said expansion gap.

36. The assembly of claim 35 which further includes aperture sleeve means for lining the aperture, said sleeve means having inner dimensions sufficiently large that said expansion gap is formed between said sleeve and said framing means when said framing means is mounted within said sleeve means.

37. The assembly of claim 36 wherein said frame tensioning means connects said framing means to said sleeve means.

38. The assembly of claim 34 wherein said expansion gap extends perimetrically around said framing means.

39. The assembly of claim 38 which further includes aperture sleeve means for lining the aperture, said sleeve means having inner dimensions sufficiently large that said perimetric expansion gap is formed between said sleeve means and said framing means when said framing means is mounted in a generally concentric orientation within said sleeve means.

40. The assembly of claim 39 wherein said sleeve means includes frame tensioning means receiving means for accepting said frame tensioning means.

41. The assembly of claim 40 wherein said frame tensioning means includes outwardly directed bolt means threadably insertable in said frame tensioning means receiving means for tensionably mounting said framing means within said sleeve means and for guiding said framing means into said gap when said framing means undergoes heat-induced expansion.

42. The assembly of claim 39 which further includes air foil means for blocking the flow of air between said sleeve means and said framing means.

* * * * *